US008807190B2

(12) United States Patent
Wills et al.

(10) Patent No.: US 8,807,190 B2
(45) Date of Patent: Aug. 19, 2014

(54) END CAP FOR ROLLER BLIND CASSETTE

(71) Applicants: Norman Wills, Mississauga (CA); Philip Ng, Thornhill (CA)

(72) Inventors: Norman Wills, Mississauga (CA); Philip Ng, Thornhill (CA)

( * ) Notice: Subject to any disclaimer, the term of this patent is extended or adjusted under 35 U.S.C. 154(b) by 0 days.

(21) Appl. No.: 13/744,204

(22) Filed: Jan. 17, 2013

(65) Prior Publication Data

US 2013/0192773 A1 Aug. 1, 2013

Related U.S. Application Data

(60) Provisional application No. 61/590,969, filed on Jan. 26, 2012.

(51) Int. Cl.
*E06B 9/17* (2006.01)

(52) U.S. Cl.
USPC ..... 160/23.1; 160/323.1

(58) Field of Classification Search
USPC ..... 160/323.1, 173 R, 173 V, 178.1 R, 160/178.1 V, 321, 23.1
IPC ..... E06B 9/17007,9/17015, 9/17023, 2009/42
See application file for complete search history.

(56) References Cited

U.S. PATENT DOCUMENTS

| | | | | | |
|---|---|---|---|---|---|
| 1,957,847 | A * | 5/1934 | Peters | 359/851 |
| 4,122,559 | A * | 10/1978 | Kelly | 4/608 |
| 4,386,644 | A * | 6/1983 | Debs | 160/174 V |
| 4,425,955 | A * | 1/1984 | Kaucic | 160/168.1 V |
| 4,754,796 | A * | 7/1988 | Ciriaci | 160/173 R |
| 5,445,205 | A * | 8/1995 | Hansen | 160/168.1 R |
| 5,464,052 | A * | 11/1995 | Wieczorek et al. | 160/23.1 |
| 6,116,322 | A * | 9/2000 | Anderson et al. | 160/168.1 V |
| 6,148,894 | A * | 11/2000 | Judkins | 160/177 R |
| 6,408,923 | B1 * | 6/2002 | Nien | 160/168.1 V |
| 6,941,996 | B2 * | 9/2005 | Ward et al. | 160/89 |

* cited by examiner

*Primary Examiner* — David Purol
(74) *Attorney, Agent, or Firm* — Honigman Miller Schwartz and Cohn LLP

(57) ABSTRACT

An end cap for enclosing or covering the end of a cassette of a roller blind or a roller shade. The cassette includes a roller having wound thereon a fabric having a bottom bar attached or otherwise secured thereto or thereover. The end cap comprises a wall portion and a bottom bar stop. The wall portion is releasably securable to an end of the cassette. The bottom bar stop is fixed to and extends outwardly from the wall portion and inhibits upward movement of the bottom bar beyond the elevation of the bottom bar stop when the end cap is secured to an end of the cassette.

5 Claims, 11 Drawing Sheets

END CAP FOR ROLLER BLIND CASSETTE

FIELD

This invention relates generally to an end cap for enclosing or covering the end of a roller blind or roller shade cassette, and in particular to such an end cap having a bottom bar stop.

BACKGROUND

Roller shades or roller blinds are common forms of window coverings used in both residential and commercial applications. Most roller shades or blinds utilize a roller tube that is retained within a frame or housing, generally referred to as a "cassette", where the roller has wound thereon one end of a fabric while the other end of the fabric is fixed or secured to the cassette. A bottom bar is attached or otherwise secured to or over the fabric to act as a weight to hold the fabric relatively taught, and to provide a pleasing visual appearance to the bottom portion of the fabric. As the fabric is wound or unwound about the exterior surface of the roller tube the amount of exposed fabric below the cassette is altered thereby allowing more or less of a window about which the blind or shade is mounted to be exposed. Typically, the bottom bar would be permitted to slide along the fabric as it is wound or unwound over the roller tube so that the bottom bar is at all times positioned at the lower-most point of the fabric that extends outwardly from the bottom of the cassette.

Others have appreciated that when winding the fabric onto the exterior surface of the roller tube (and effectively "opening" the blind or shade), eventually the bottom bar will be raised upwardly until it reaches a point of contact with the cassette. Doing so can often have the undesirable effect of pinching the fabric between the bottom bar and a portion or portions of the cassette, which in some instances can result in damage to the fabric, or in other instances result in a creasing or pleating of the fabric, both of which can diminish the appearance of the blind. In order to prevent the bottom bar from contacting the cassette and to help prevent any resulting damage, pleating or creasing of the blind fabric, where the roller tube is activated through the movement of a chain it has been proposed to incorporate a chain stop that prohibits the chain from being moved beyond a predetermined position. In that manner the roller tube is prevented from being wound to the point where the bottom bar contacts the cassette. Others have also suggested that installers screw, bolt or otherwise clamp separate and discrete bottom bar stops onto the rear face of the cassette during installation of the blind or shade, where such stops limit the upward movement of the bottom bar. While both of these methods have met with limited success, each requires manufacturers to produce separate independent components, requires installers to expend time and effort to install chain stops or bottom bar stops, and each also suffers from the potential of the stops being later removed or falling off, leaving the bottom bar open to being lifted to the point where it pinches the fabric against the cassette. It will also be appreciated that in instances where the roller tube is operated by an electric motor, or by a clutch that is activated by a cord or cable, the utilization of a traditional chain stop will be ineffective.

SUMMARY

The invention therefore provides an improved end cap with a bottom bar stop for use on a roller blind or roller shade.

Accordingly, there is provided an end cap for enclosing or covering the end of a cassette of a roller blind or a roller shade, the cassette including a roller having wound thereon a fabric having a bottom bar attached or otherwise secured thereto or thereover, the end cap comprising a wall portion and a bottom bar stop, the wall portion releasably securable to an end of the cassette, the bottom bar stop fixed to and extending outwardly from said wall portion and inhibiting upward movement of the bottom bar beyond the elevation of said bottom bar stop when said end cap is secured to an end of the cassette.

In a further aspect there is provided an end cap for enclosing or covering the end of a cassette of a roller blind or a roller shade, the cassette including a roller having wound thereon a fabric having a bottom bar attached or otherwise secured thereto or thereover, the end cap comprising a wall portion releasably securable to an end of the cassette, the wall portion having an integrated bottom bar stop extending outwardly from a rear portion thereof, said bottom bar stop inhibiting upward movement of the bottom bar beyond the elevation of said bottom bar stop when said end cap is secured to an end of the cassette Further aspects and advantages will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments in which.

DESCRIPTION

Figure 1:
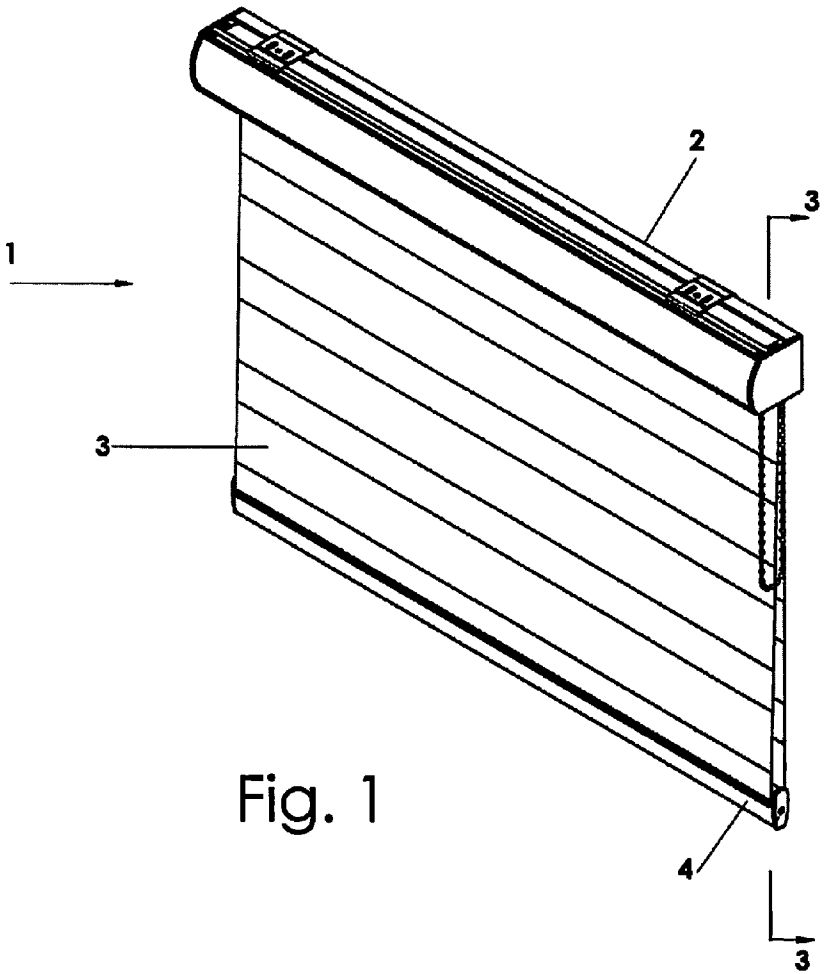
FIG. 1 is a side perspective view of a roller blind or roller shade cassette having a shade fabric and a bottom bar attached thereto.
Figure 2:
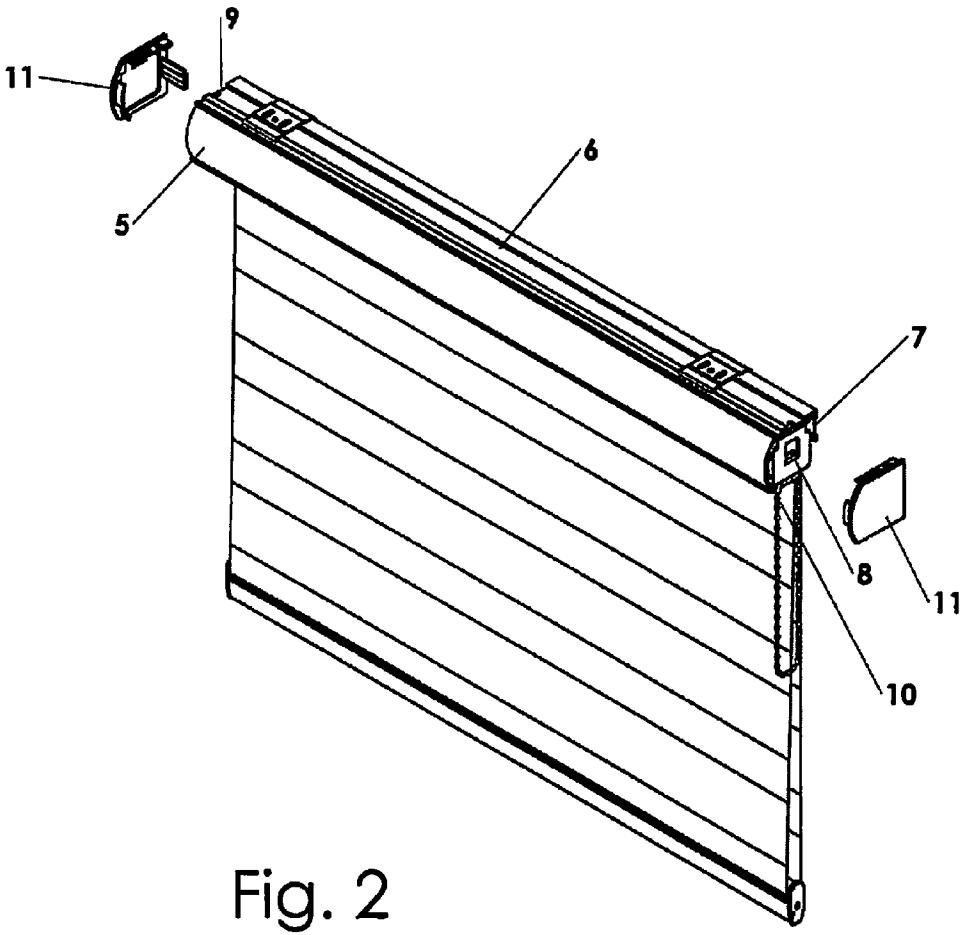
FIG. 2 is a view similar to FIG. 1, but with the end caps shown in exploded view.
Figure 3:
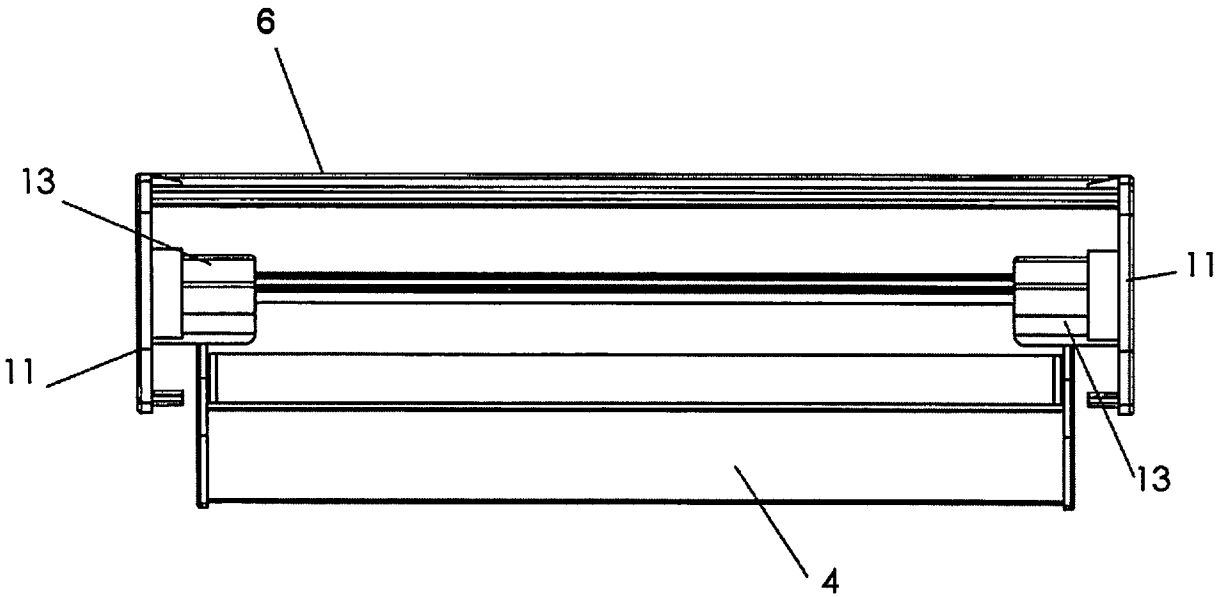
FIG. 3 is a vertical sectional view taken along the line 3-3 of FIG. 1 when the blind is in its open position.
Figure 4:
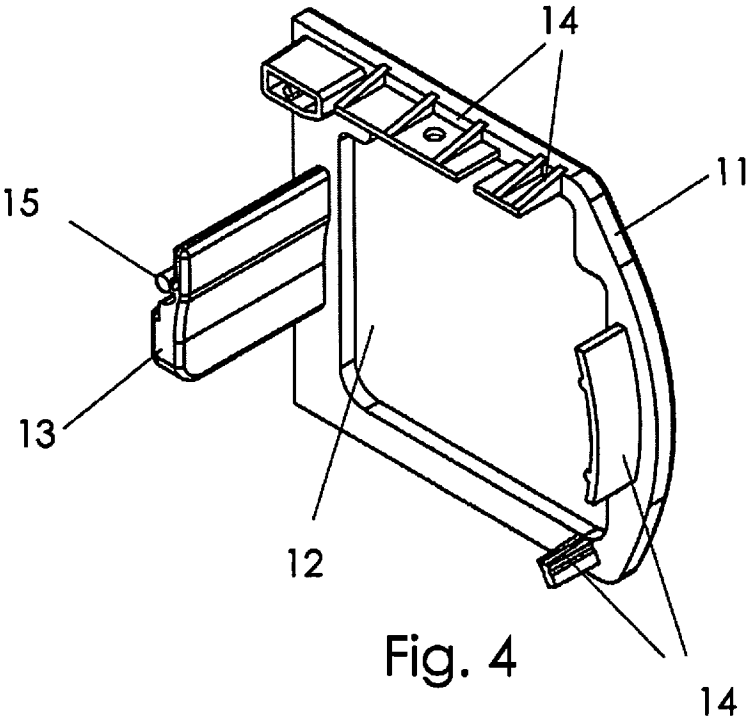
FIG. 4 is an inner perspective view of the end cap shown in FIGS. 1 through 3.
Figure 5:
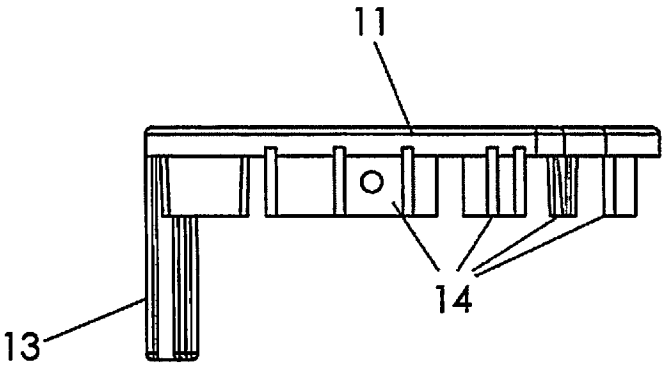
FIG. 5 is a top or plan view of the end cap shown in FIG. 4.
Figure 6:
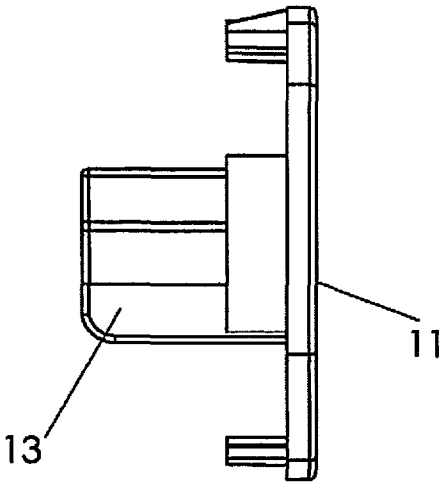
FIG. 6 is a right hand view of the end cap shown in FIG. 4.
Figure 7:
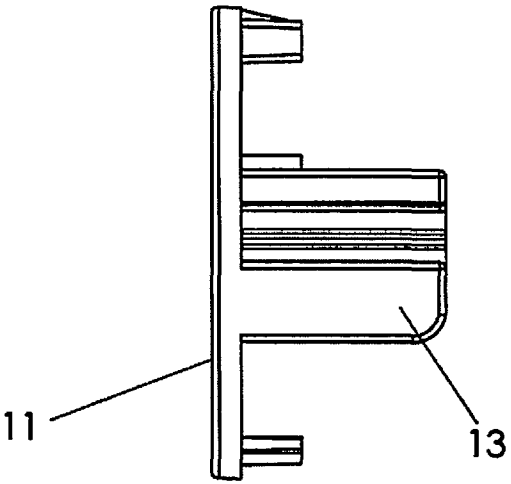
FIG. 7 is a left hand view of the end cap shown in FIG. 4.
Figure 8:
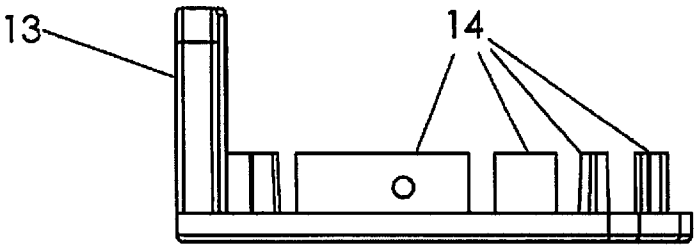
FIG. 8 is a bottom view of the end cap shown in FIG. 4.
Figure 9:
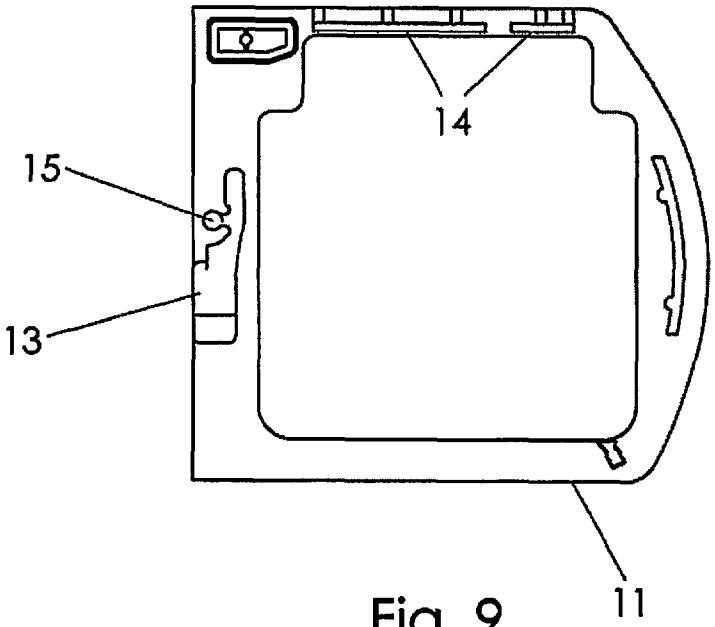
FIG. 9 is an inside elevational view of the end cap shown in FIG. 4.
Figure 10:
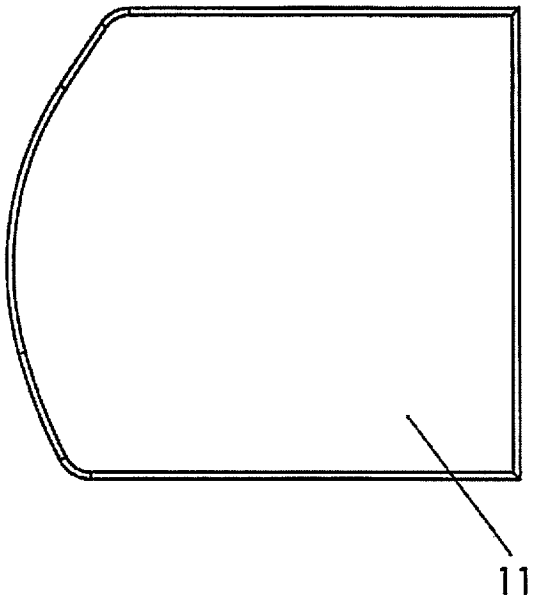
FIG. 10 is an outside elevational view of the end cap shown in FIG. 4.

The present invention may be embodied in a number of different forms. However, the specification and drawings that follow describe and disclose only some of the specific forms of the invention and are not intended to limit the scope of the invention as defined in the claims that follow herein.

In the attached Figures there is shown a roller blind or shade 1 that is comprised generally of a cassette 2 having extending therefrom a fabric 3. Attached or otherwise secured to or over the fabric is a bottom bar 4. Cassette 2 may be of any common structure and configuration, but will in most instances have a front panel 5, a top panel 6 and a rear panel 7 that together form an enclosure or frame to which end plates 8 and 9, respectively, can be mounted for receiving a roller tube 10. Fabric 3 is wound and unwound about the exterior surface of roller tube 10. Roller tube 10 can be activated through any one of a wide variety of common methods including through the use of a clutch, that is driven by a cord or a chain, or through the use of an electric motor. In any case, one end of fabric 3 would commonly be fixed within the interior of cassette 2 with the other end secured to the roller tube, such that rotating the roller tube in one direction causes the fabric to wind onto the exterior surface of the tube. As the fabric is wound onto the roller tube the amount of fabric extending outwardly through the bottom of the cassette is reduced, causing the blind to "open" and lift bottom bar 4. Similarly, rotating the roller tube in the opposite direction will unwind fabric from the tube and effectively lengthen the amount of fabric extending downwardly out of the cassette to "close" the blind and lower bottom bar 4. The bottom bar serves the dual function of helping to maintain fabric 3 in a relatively taught configuration as well as providing a visually pleasing lower finishing edge to the blind or shade fabric.

In accordance with the invention there is further provided an end cap 11 for enclosing or covering the end of cassette 2. In most instances it is expected that two end caps will be provided, one for the right and one for the left end of the cassette. End caps 11 are comprised generally of a wall portion 12 and a bottom bar stop 13. Wall portion 12 is releasably securable to the end of cassette 2, while the bottom bar stop is fixed to and extends outwardly from the inner surface of wall portion 12. In this manner, when end cap 11 is secured to the end of cassette 2 bottom bar stop 13 will effectively extend inwardly toward the interior of the cassette. The bottom bar stop will be positioned in such a manner that it will inhibit the upward movement of the bottom bar beyond the elevation of the lower surface of the bottom bar stop when fabric 3 is wound onto roller tube 10. It will be appreciated that in some instances the nature of fabric 3 and the configuration of the rear panel of the cassette will have a bearing upon where along the surface of wall portion 12 bottom bar stop 13 should be positioned. The structure and configuration of the bottom bar may also to some degree dictate the location of the bottom bar stop along the wall portion of the end cap. In most cases it is expected that the bottom bar stop will extend outwardly from the rearward portion of wall portion 12.

End cap 11 may also include locking tabs 14 that permit the end cap to be secured to the ends of cassette 2. It will be appreciated that in other instances a wide variety of other types of mechanical fastening mechanisms (which may include but are not limited to screws, bolts, rivets, hook and loop fasteners, etc) could be utilized in order to hold the end cap in place.

It is expected that end cap 11 will commonly be formed from aluminum or a similar metal, or moulded from a plastic or similar type material, and that bottom bar stop 13 and wall portion 12 will be of unitary construction. It should also be noted that in some cases end cap 11 could comprise a structural component of cassette 2, while in other instances the end cap will merely comprise a trim cap that fits about the end of the cassette to enhance its aesthetic appearance.

Figure 11:
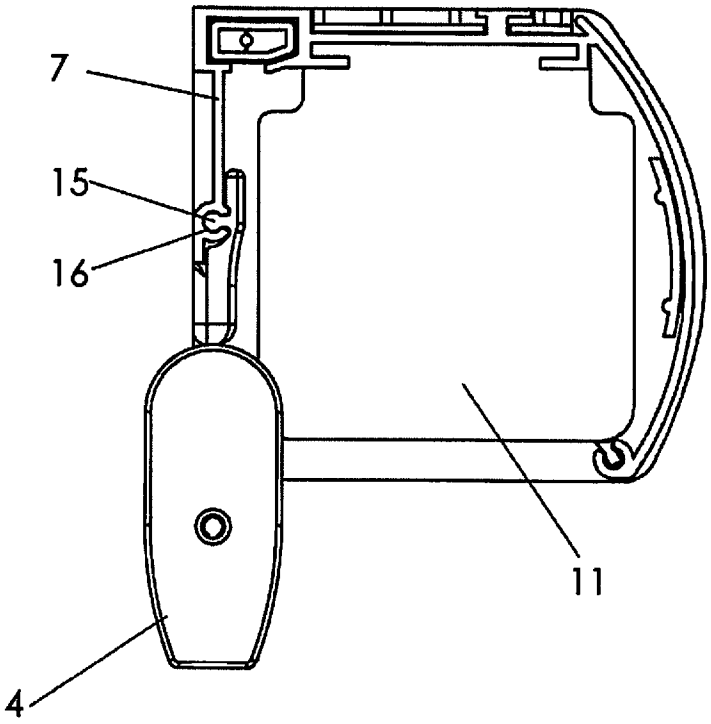
FIG. 11 is an inside view of the end cap shown in FIG. 4, similar to that shown in FIG. 9, showing the rear and top panels of the cassette and with the bottom bar in its fully retracted position abutting against the bottom bar stop.

In one embodiment of the invention, end cap 11 includes means to secure bottom bar stop 13 to rear panel 7 of cassette 2. One such means comprises a rail 15 on bottom bar stop 13 that is received within a generally correspondingly shaped channel 16 on rear panel 7 (see FIG. 11).

From a thorough understanding of the invention one of ordinary skill in the art will understand that end cap 11, having securely fixed thereto a bottom bar stop 13, will present a structural mechanism that will inhibit the upward movement of the bottom bar beyond the elevation of the lower surface of the stop when the end cap is secured to the end of cassette 2. The distance or the amount of offset between the bottom bar stop and cassette 2 can be specifically defined and controlled through manufacturing processes and is not left to the discretion of the installer. Further, thorough the integration of a bottom bar stop into end cap 11 the need for additional parts and components, and the resulting costs of manufacturing multiple components, is reduced, as is the time and expense associated with installing the blind. Further, the situation where an installer fails to install a bottom bar stop, or where an installed stop is subsequently removed or falls off, is eliminated.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. An end cap for enclosing or covering the end of a cassette of a roller blind or a roller shade, the cassette including a rear panel and a roller having wound thereon a fabric having a bottom bar attached or otherwise secured thereto or thereover, the end cap comprising a wall portion and a bottom bar stop, the wall portion releasably securable to an end of the cassette, the bottom bar stop fixed to and extending outwardly from said wall portion and inhibiting upward movement of the bottom bar beyond the elevation of said bottom bar stop when said end cap is secured to an end of the cassette, said end cap including a rail on said bottom bar stop that is longitudinally receivable within a generally correspondingly shaped channel on the rear panel to secure said bottom bar stop to the rear panel of the cassette, said end cap comprising a trim cap to enhance the aesthetic appearance of the cassette.

2. The end cap as claimed in claim 1 wherein said bottom bar stop and said wall portion are of unitary construction.

3. The end cap as claimed in claim 2 wherein said wall portion includes a rearward portion, said bottom bar stop extending outwardly from said rearward portion.

4. The end cap as claimed in claim 1 wherein said wall portion includes locking tabs to secure said end cap to said cassette.

5. The end cap as claimed in claim 1 formed from plastic or aluminum.

* * * * *